United States Patent [19]

Klann

[11] Patent Number: 4,597,284

[45] Date of Patent: Jul. 1, 1986

[54] PRESSING TOOL FOR SECURING SCREW CONNECTIONS

[76] Inventor: Horst Klann, Terra Wohnpark 13, 7730 Villingen-Schwenningen 24, BRD, Fed. Rep. of Germany

[21] Appl. No.: 691,447

[22] Filed: Jan. 14, 1985

[30] Foreign Application Priority Data

Jan. 16, 1984 [DE] Fed. Rep. of Germany ... 8401094[U]

[51] Int. Cl.[4] ..... B21D 7/06

[52] U.S. Cl. ..... 72/407; 72/402; 72/452; 72/461

[58] Field of Search ..... 72/407, 402, 452, 409, 72/410, 461, 125; 29/237, 261, 282, 283.5

[56] References Cited

U.S. PATENT DOCUMENTS

| | | | |
|---|---|---|---|
| 1,782,219 | 11/1930 | Wallace | 29/237 |
| 2,295,033 | 9/1942 | Fagan | 72/402 |
| 3,072,174 | 1/1963 | Vanderhoof | 29/237 |
| 3,877,284 | 4/1975 | Amtsberg et al. | 72/402 |
| 3,879,834 | 4/1975 | Johnson | 72/402 |
| 4,106,175 | 8/1978 | Meyer | 72/402 |
| 4,227,395 | 10/1980 | Plavsity | 72/452 |

FOREIGN PATENT DOCUMENTS

| | | | |
|---|---|---|---|
| 427859 | 4/1926 | Fed. Rep. of Germany | 72/402 |
| 48780 | 3/1921 | Sweden | 72/402 |

OTHER PUBLICATIONS

Byrd, P. W., et al., "Terminal Bending Apparatus" from Western Electric Technical Digest No. 10, Apr. 1968, p. 11.

*Primary Examiner*—Daniel C. Crane

*Attorney, Agent, or Firm*—McGlew and Tuttle

[57] ABSTRACT

A pressing tool for securing screw connections of steering linkages of motor vehicles particularly between a ball joint socket having a tubular extension and a threaded pin of a pitman arm which has two diametrically opposite parallel wrench flats which are positioned within a tubular extension of the ball joint socket. A tubular extension comprises a sleeve arranged over the ball joint socket and it has two diametrically opposed longitudinally extending slots each having a double arm lever pivotally mounted therein. The double arm lever includes a first arm portion providing a jaw oriented radially inwardly and an opposite arm portion having a camming surface. A control member is located in the sleeve adjacent the camming surface of each lever and it is mounted so as to be threadably movable axially to run along the camming surface and pivot the lever. The lever arm which has the jaw is moved by the control member to engage and deform a deformable cylindrical portion carried by the ball joint socket so that the deformed portions engage against the flats so that the pitman arm with turn with the rotation of the ball joint socket member.

6 Claims, 9 Drawing Figures

PRESSING TOOL FOR SECURING SCREW CONNECTIONS

FIELD AND BACKGROUND OF THE INVENTION

This invention relates in general to special tools for handling confined parts and in particular to a new and useful pressing tool for securing screw connections between steering linkages of motor vehicles.

The invention relates particularly to a pressing tool to secure screw connections on motor vehicle steering linkages, in particular the screw connection between a ball joint socket having a cylindrical, tubular extension and the threaded pin of a pitman arm. The pitman arm is provided with two diametrically opposed, mutually plane-parallel, wrench flats which partly project into the tubular extension of the ball joint socket and against which part sections of the tubular extension of the ball joint socket can be applied in form-closing fashion by radial press deformation.

There are motor vehicles, in particular passenger cars, where such steering linkages are so closely enveloped by other body or engine parts that the wrench flats of the screw connections, i.e. of the ball joint socket and pitman arm, are not accessible for conventional tools. Consequently, it is not possible, with conventional squeezing tools to press the cylindrical, tubular extension of a ball joint socket which has been replaced in the course of repair work, against the wrench flats of the pitman arm so as to secure the screw connection against disconnecting by itself.

Since some screw connections are accessible in some motor vehicles only from the free end of the steering rod pivoted in the ball joint socket, it is the object and the task of the invention to create a pressing tool which can be pushed over the ball joint socket from the free end of the steering rod, can also be actuated from the free end of the steering rod, and which makes it possible to press sections of the cylindrical, tubular extension of the ball joint socket against the wrench flats of the pitman arm of the respective steering linkage, by simple manipulation and application of the pressing tool.

SUMMARY OF THE INVENTION

According to the invention, there are pivoted, in the wall of an essentially tubular sleeve part having two diametrically opposed, slotlike recesses, two dual-armed pressing levers, each pivoting about pivot pins disposed eccentric to the sleeve part axis and fastened in cross holes in the wall; the pressing levers each having pressing jaws oriented radially inward and disposed a certain distance from a stop disposed inside the sleeve part; and there is disposed in the sleeve part, on the side of the stop opposite the pressing jaws, a control element which is axially adjustable by means of a hollow screw and through the axial motion of which the two pressing levers are pivotable.

Another embodiment of the invention provides for the sleeve part to be provided, on its face opposite the hollow screw, with a ring part which has, at least at one point of its circumference, an open slot opening to accommodate a fork wrench which fits the wrench flats of the pitman arm and by means of which the two pressing jaws can be aligned with the wrench flats of the pitman arm.

This makes it possible in a simple manner to align the two pressing jaws with the wrench flats of the pitman arm and to fix them in the aligned angular position so that, when executing the pressing operation by turning the hollow screw, the sleeve part can no longer turn relative to the pitman arm.

A further development of the invention provides for the control element to comprise a disc fastened to the hollow screw, against which disc rest the lever arms of the two pressing levers which are opposite the pressing jaws and have oblique bearing surfaces. This results in a simple and space-saving, as well as reliably functioning arrangement for the actuation of the two pressing arms.

It is particularly advantageous if the control element is mounted rotatably and coaxially on the hollow screw so that the control element need perform no rotary motion together with the hollow screw relative to the two pressing levers with which it makes contact.

The hollow screw itself is expediently disposed in a central, tapped hole in a face plate detachably fastened to a face of the sleeve part.

This assures that the hollow screw can readily be removed from and refastened to the sleeve part together with the control element; an advantage not only during the original assembly, but also when later applying lubricants to the control element or to the pressing levers, or in case of repair work to replace the control element.

Another advantageous embodiment of the invention is that the sleeve part has, between its inner stop and the ring part attached to its face, a cylindrical cavity whose diameter equals, or is but slightly greater than, the outside diameter of the ball joint socket to be worked on.

This can assure self-centering of the sleeve part or the entire pressing tool on the ball joint socket to be worked on, thus facilitating the handling of the pressing tool.

Accordingly it is an object of the invention to provide an improved means for facilitating the connection and disconnection of linkages arranged in confined spaces using a tubular extension which is secured to one part which has levers mounted thereon which are manipulatable to form a tight turning engagement with the other part.

A further object of the invention is to provide a device for facilitating the joining of a ball joint socket with an end of a pitman arm.

A further object of the invention is to provide a pressing tool which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2, 3, 4, 5:
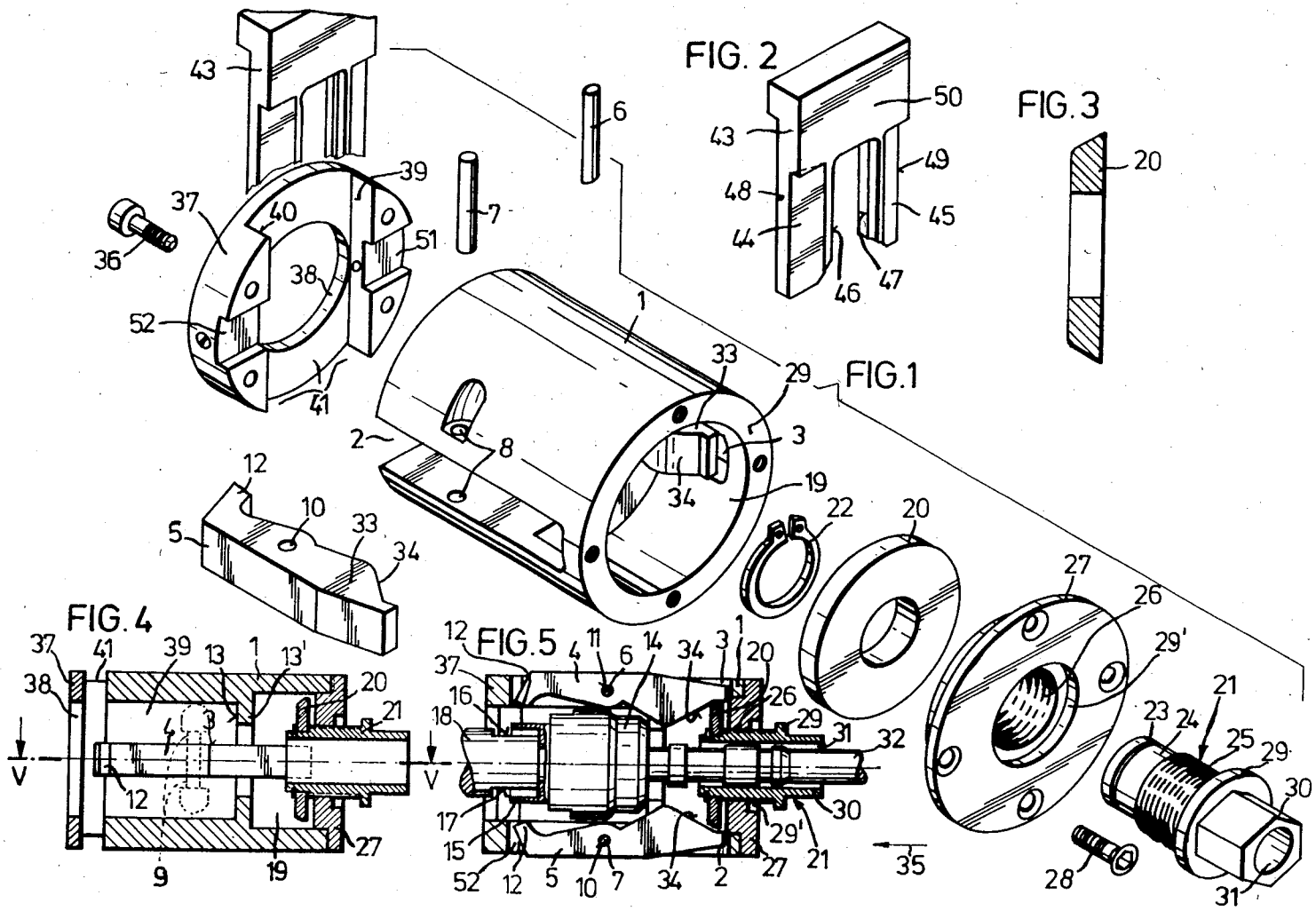
FIG. 1 shows components of a pressing tool in perspective, exploded view.
FIG. 2 is a perspective side view of a fork wrench.
FIG. 3 is a section of a disc-shaped control element.
FIG. 4 is a sectional view of the assembled pressing tool of FIG. 1.
FIG. 5 is a section taken along the line V—V of FIG. 3 with a portion of a steering linkage.

Referring to the drawings in particular, the invention embodied therein comprises a pressing tube for securing connections of steering linkages of motor vehicles between a ball joint socket 14 having a tubular extension 1 and a threaded pin of a pitman arm 18 which has two diametrically opposite parallel flats 16 and 17 which are positioned within a tubular extension 37 of the ball joint socket 14. The arrangement includes a tubular sleeve part 1 arranged over the ball joint socket 14 which has two diametrically spaced longitudinally extending slots 2 and 3 with double armed lever members 4 and 5 pivotally mounted in respective slots eccentrically of the axis of the sleeve part. Each of the double arm levers have a first arm portion providing a pressing jaw oriented radially inwardly and an opposite second arm portion with a camming surface. A tubular sleeve is designed to have an internal stop 13 spaced from the levers and a hollow screw member 21 insertably engageable in an end plate of the tubular extension so as to position a control disc or control member 26 relative to the camming surface 34 of the opposite second arm part of the double armed levers. A control member 36 is threadably engaged on the hollow screw 21 and it may be advanced relative to the caming surface 34 so as to cause the jaw portions 12 to move into engagement with a deformable cylindrical extension of the ball joint to cause it to engage in flats defined on the pitman so that the rotation of the ball joint will effect rotation of the pitman.

As may best be seen from FIGS. 1 through 5, the pressing tool according to the invention comprises a tubular sleeve part 1 which has two diametrically opposed, slot-like recesses 2 and 3. Accommodated in each of these recesses 2 and 3 are dual-armed pressing levers 4 and 5 in mirror image arrangement, and they are pivoted in pivot pins 6 and 7 fastened in eccentric cross holes 8 and 9 in the wall of the sleeve part 1. The pivot pins 6 and 7 penetrate the respective holes 10 and 11 of the pressing levers 4 and 5. The shape of the pressing levers 4 and 5 is identical. Each pressing lever has a pressing jaw 12, spaced in axial direction from an inner stop 13 of the sleeve part 1 by a certain distance which depends on the length of the ball joint 14 shown in FIGS. 4, 5 and 9. This distance is selected so that the two pressing jaws, when pivoted inwardly, strike the thin-walled and therefore deformable tubular extension 15 of the ball joint 14 in order to press part sections of this tubular extension 15 radially inward against the two diametrically opposed, plane-parallel, wrench flats 16 and 17 of a pitman arm 18 screwed coaxially to the ball joint. The stop 13 is formed by the annular face of an inner ring flange 13'.

Figures 6, 7, 8, 9:
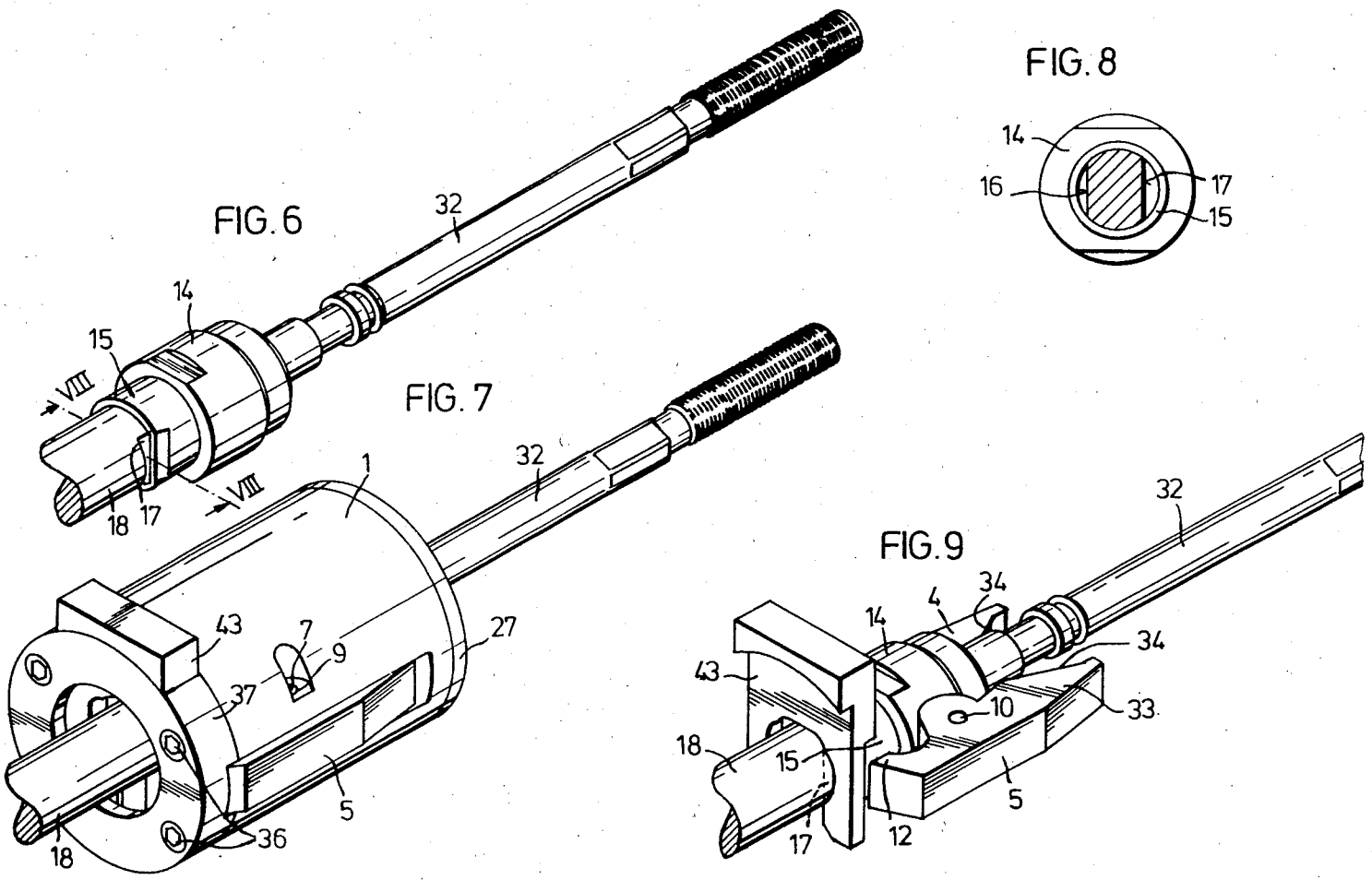
FIG. 6 is a view of a ball joint of a steering rod screwed to a pitman arm and secured against rotation, in perspective.
FIG. 7 is a view of the complete pressing tool, pushed over the ball joint of FIG. 6, in perspective side view.
FIG. 8 is a section taken along line VIII—VIII of FIG. 6.
FIG. 9 is a perspective view of the fork wrench of FIG. 2, form-closingly applied to the wrench flats of the pitman arm, and two pressing levers in the working position of FIG. 7, except without the sleeve part in which they are mounted in the assembled state of the pressing tool.

To be able to pivot the two pressing levers in this sense by the exertion of much force, there is disposed on the side of stop 13 opposite the pressing jaws 12 in a cylindrical cavity 19 a control element 20 in the form of a tapered, annular disc rotatable fastened to a hollow screw 21 by means of a snap ring 22. This snap ring 22 sits in a ring slot 23 in a cylindrical extension 24 on which the control element 20 is rotatably mounted. The hollow screw 21 is screwed by means of its thread 25 into a central, tapped hole 26 in a face plate 27 detachably fastened by means of screws 28 to the face 29 of the sleeve part 1 opposite to the pressing jaws 12. In addition, the hollow screw 21 has a stop collar 29'' and wrench flats 30. A concentric, annular recess 29' is provided for the stop collar 29 on the outside diameter of the face plate 27. The cylindrical, axial through hole 31 of the hollow screw 21 is of a diameter to allow the steering rod 32 of the ball joint 14 to pass through easily, i.e. with a certain radial clearance when it is intended to attach the pressing tool to the ball joint 14 as shown in FIGS. 5 and 7.

Each of the lever arms 33 of the pressing levers 4 and 5 opposite the pressing jaws 12 have oblique bearing surfaces 34, contacted by the control element 20 when the latter moves in the direction of arrow 35 due to the appropriate rotation of the hollow screw 21. Due to this axial motion of the control element 20, the two pressing levers 4 and 5 are pivoted about the axes of their pivot pins 6 and 7 simultaneously and in mirror image relative to each other so that their pressing jaws 12 move inwardly, pressing the sections of the tubular extension 15 of the ball joint 14 with which they make contact, thereby deforming the wrench flates 16 and 17 of the pitman arm 18 so that the latter provide an antirotation lock which prevents the screw connection between the pitman arm 18 and the ball joint 14 from unscrewing by itself.

On the face of the sleeve part 1 opposite the face plate 27 there is fastened by means of screws 36 a ring part 37 of the same outside diameter as the sleeve part 1 and having a bore 38 of at least approximately the same diameter as that of the cavity 39 which harmonizes with the outside diameter of the ball joint 14 and is located between the stop 13 and the ring part 37, serving the accommodation of the ball joint 14 in the manner evident from FIG. 5. The diameter of this cavity harmonizes with the outside diameter of the ball joint 14 in such a manner that the sleeve part 1 can be pushed over the ball joint 14 with little radial clearance and at the same time be centered so that the two pressing levers 4 and 5 can attack the tubular extension 15 as uniformly as possible from both diametrically opposed sides.

The ring part 37 has a diametric recess 41 which is limited by plane-parallel guide surfaces 39 and 40 and results, together with the face 42 of the sleeve part 1, in a slot opening, open on the circumference, in which a fork wrench 43 is insertable in radial direction. This fork wrench 43 has two parallel fork legs 44 and 45 with plane-parallel inside surfaces 46 and 47 as well as outside surfaces 48 and 49 in accordance with the width of the recess 41. The fork legs 44 and 45 are integrally interconnected by a web back 50. The distance between the plane-parallel inside surfaces 46 and 47 harmonizes with the distance between the two wrench flates 16 and 17 of the pitman arm 18 so that they can be accommodated form-closingly and secure against rotation by the two fork legs 44 and 45 as shown in FIG. 9 when the fork wrench 43 is inserted in the recess 41 of the ring part 37 as shown in FIG. 7. By means of the fork wrench 43, applied to the wrench flats 16 and 17 of the pitman arm 18 prior to the actuation of the two processing levers 4 and 5, the two pressing jaws 12 are automatically aligned with the wrench flats 16 and 17, and the entire pressing tool is fixed in this aligned angular position.

To assure the radial freedom of motion of the pressing jaws 12 of the two pressing levers 4 and 5 there are disposed in the two faces of the ring part 37 located on both sides of the recess 41 and facing the sleeve part 1 transverse slots 51 and 52 of the same width as the recesses 2 and 3 of the sleeve part 1, each forming extensions of these recesses 2 and 3.

After the ball joint 14 of a steering linkage of the kind illustrated in the drawing and installed in a vehicle has been replaced, the tubular extension 15 must partly be pressed against the wrench flats 16 and 17 to secure the screw connection between the ball joint 14 and the pitman arm 18. This can be done in simple manner with the aid of the above described pressing tool also when the entire steering linkage is closely enveloped by anybody and/or engine parts which prevent the application of conventional squeezing tools.

For, the pressing tool described, due to its space saving design as a sleeveshaped, hollow part, can easily be pushed from the free end of the steering rod over the ball joint 14 in the manner shown in FIGS. 5 and 7 far enough so that when the stop 13 is in contact with the face of the ball joint, the two pressing jaws assume the correct position relative to the tubualr extension 15. All that is yet required is to find, by appropriately turning the pressing tool, the particular angular position in which the fork wrench 43 can be pushed over the wrench flats 16 and 17 so that the entire pressing tool is secured against any change in position in both axial and circumferential direction. In this fixed position it is then easily possible to effect the pressing motion of the two pressing levers 4 and 5 by screwing the hollow screw in. To turn the hollow screw, a socket wrench which can be pushed over the steering rod 32 may be inserted in its wrench profile 30.

While specific embodiments of the invention have been shown and described in detail to illustrate the application of the principles of the invention, it will be understood that the invention may be embodied otherwise without departing from such principles.

What is claimed is:

1. A pressing tool for securing screw connections of steering linkages of motor vehicles particularly between a ball joint socket having a tubular extension and a threaded pin of a pitman arm which has two diametrically opposite parallel wrench flats which are positioned within a tubular extension of the ball joint socket, comprising a tubular sleeve part arranged over the ball joint socket and having two diametrically opposite longitudinally extending slots, a double armed lever pivotally mounted in each slot eccentrically of the axis of said sleeve part and each having a first arm part defining a pressing jaw oriented radially inwardly and an opposite second armed part with a camming surface, and a control member in said tubular sleeve part engageable with said cam surface to pivot said levers, means mounting said control member for axial movement relative to said tubular sleeve part to move said control member along said camming surface to cause pivoting of said double armed levers, said ball joint socket having a deformable portion aligned with each pressing jaw which are deformed by movement of said jaw by said control member to provide formed closing engagement between the flats of said pitman arm and said ball joint socket, said tubular sleeve part having and end face with a ring part having a slot opening, opening at at least one part of its circumference, and a fork wrench member engageable in said slot and fitting on each side of the flats of said pitman arm for aligning said pressing jaws with said wrench flats.

2. A pressing tool according to claim 1, wherein said control member comprises a disc, said tubular sleeve part having an end with a threaded opening, a hollow screw threaded into said opening, said disc being threaded on said threaded hollow screw, said second arm part of said double armed lever bearing against said control member.

3. A pressing tool according to claim 2, wherein said control member is mounted for rotation coaxially of said hollow screw.

4. A pressing tool according to claim 2, wherein said hollow screw is threadably engaged with said tubular sleeve part.

5. A pressing tool according to claim 1, wherein said tubular sleeve part has an interior stop part, and a ring part closing the end thereof into which said pitman arm engages the interior defining within said tubular extension a cylindrical cavity having a diameter at least equal to the outside diameter of said ball joint.

6. A pressing tool for securing screw connections of steering linkages of motor vehicles particularly between a ball joint socket having a tubular extension and a threaded pin of a pitman arm which has two diametrically opposite parallel wrench flats which are positioned within a tubular extension of the ball joint socket, comprising a tubular sleeve part arranged over the ball joint socket and having two diametrically opposite longitudinally extending slots, a double armed lever pivotally mounted in each slot eccentrically of the axis of said sleeve part and each having a first arm part defining a pressing jaw oriented radially inwardly and an opposite second armed part with a camming surface, and a control member in said tubular sleeve part engageable with said cam surface to pivot said levers, means mounting said control member for axial movement relative to said tubular sleeve part to move said control member along said camming surface to cause pivoting of said double armed levers, said ball joint socket having a deformable portion aligned with each pressing jaw which are deformed by movement of said jaw by said control member to provide formed closing engagement between the flats of said pitman arm and said ball joint socket, said tubular sleeve part including an end portion having a diametrically extending slot and a fork wrench engaged in said slot having parallel leg forks which engage in respective flats of said pitman arm and including a web part joining said leg parts together.

* * * * *